US006170537B1

(12) United States Patent
Lasserre

(10) Patent No.: US 6,170,537 B1
(45) Date of Patent: Jan. 9, 2001

(54) VALVE FOR DISPENSING A PRESSURIZED LIQUID, CONTAINER FITTED WITH THIS VALVE, AND METHOD OF PACKING A CONTAINER THUS EQUIPPED

(75) Inventor: Pierre-André Lasserre, Coubron (FR)

(73) Assignee: L'Oreal, Paris (FR)

( * ) Notice: Under 35 U.S.C. 154(b), the term of this patent shall be extended for 0 days.

(21) Appl. No.: 09/447,562

(22) Filed: Nov. 23, 1999

(30) Foreign Application Priority Data

Nov. 23, 1998 (FR) ..... 98 14724

(51) Int. Cl.[7] ..... B65B 1/04
(52) U.S. Cl. ..... 141/3; 222/402.16; 141/20
(58) Field of Search ..... 141/3, 20; 222/402.1, 222/402.16, 402.17, 402.18

(56) References Cited

U.S. PATENT DOCUMENTS

| | | | | |
|---|---|---|---|---|
| 3,674,185 | * | 7/1972 | Evesque | 222/402.16 |
| 3,981,674 | | 9/1976 | Mildern . | |
| 4,015,752 | * | 4/1977 | Meuresch et al. | 222/402.16 |
| 4,730,752 | * | 3/1988 | Kimball et al. | 222/394 |

FOREIGN PATENT DOCUMENTS

| | | |
|---|---|---|
| 0 045 384 | 2/1982 | (EP) . |
| 0 850 851 | 7/1998 | (EP) . |
| 1 076 329 | 7/1967 | (GB) . |
| 2 143 590 | 2/1985 | (GB) . |

* cited by examiner

*Primary Examiner*—Steven O. Douglas
(74) *Attorney, Agent, or Firm*—Oblon, Spivak, McClelland, Maier & Neustadt, P.C.

(57) ABSTRACT

A valve is fitted to a reservoir containing a pressurized product. The valve has a valve body made of an elastomeric material and an activation element for, in response to an actuation command, causing the valve to move from a closed position into a position which allows the product to be dispensed. The valve body includes a first mounting device to allow the valve to be mounted in a first position in which the valve body defines, with an edge of an opening in the reservoir, at least one passage communicating with the reservoir, so as to allow the reservoir to be filled with a propellent gas. A second mounting device allows the valve to be mounted in a second position in which the valve body is mounted in a sealed fashion on the edge of the opening in the reservoir. A container fitted with this valve and a method of packing it are also disclosed.

24 Claims, 3 Drawing Sheets

VALVE FOR DISPENSING A PRESSURIZED LIQUID, CONTAINER FITTED WITH THIS VALVE, AND METHOD OF PACKING A CONTAINER THUS EQUIPPED

CROSS REFERENCE TO RELATED APPLICATION

This application relates to French Patent Application Serial No. 98-14,724 filed Nov. 23, 1998, from which priority is claimed.

BACKGROUND OF THE INVENTION

1. Field of the Invention

The present invention relates to a valve for dispensing a product, particularly a liquid, to a container intended to contain this product and fitted with this valve, and to a method of packing such a container under pressure under the action of a propellent gas. More specifically, the valve according to the invention is designed to simplify its mounting on such a container and, from an industrial point of view, to make pressurizing easier. Such a container, commonly known as an aerosol dispenser, is intended, in particular, for the packaging and dispensing of a fluid product, such as a cosmetic, dermatological, household, food or workshop product, such as, for example, a hair spray, a hair mousse, a disinfectant spray, a lubricant spray, a paint or a cleaning product.

The valve fitted to this kind of aerosol container comprises an operating stem arranged axially in a valve body. The operating stem has a passage for the product that is to be dispensed. The valve comprises sealing means capable of closing the passage. The operating stem can be moved elastically by tilting the stem sideways in the valve body between a first position in which it closes off the passage, where the stem occupies a position in which the passage is isolated from the pressurized product by the sealing means, and a second, open, position. In this second position, the stem is inclined relative to the axis of the valve body, said passage being in communication with the pressurized product, to allow the product to be dispensed. The valve furthermore comprises elastic return means which urge the stem into the first position. Furthermore, the valve may also be made to open by depressing it axially, thus being advantageous for filling the container on a packaging line.

In general, an aerosol product is packaged as follows: the product that is to be dispensed, generally liquid, is introduced through the open orifice of a container, then the container is closed by crimping a valve-holder dished part fitted with a valve. To pressurize the product, an appropriate amount of propellent gas is then injected through the valve stem, keeping this stem in a depressed position.

2. Description of the Related Art

A valve of the aforementioned kind is described in European Patent No. 850,851. In practice, a valve of this kind operates satisfactorily. However, the inventor has noticed that a dispenser fitted with such a valve does have a drawback—namely that the rate at which propellant can be introduced using industrial packaging equipment leaves something to be desired.

The inventor has therefore sought a solution to make an aerosol container quicker and easier to pressurize, particularly on an automatic packaging line.

The present invention sets out to remedy the drawbacks of the valve described in European Patent No. 850,851, by proposing a valve of a simple construction which is easy to fit to any type of pressurized container. Furthermore, the cost price of the valve envisioned by the invention is advantageous.

SUMMARY OF THE INVENTION

A first aspect of the invention relates to a dispensing valve intended to be fitted to a container containing a product which is pressurized by a propellent gas. The invention comprises a valve body made of an elastomeric material and an activation means for, in response to an actuation command, causing the valve to move from a closed position into a position which allows the product to be dispensed via an outlet passage of the valve body, said valve being, in the absence of any actuation command, forced into the closed position, said valve body comprising first mounting means to allow the valve to be mounted in a first position in which the valve body defines, with an edge of the container, at least one passage communicating with the container, so as to allow the container to be filled with a propellent gas, and second mounting means to allow the valve to be mounted in a second position in which the valve body is mounted in a sealed fashion on the edge of the container.

Advantageously in the invention, the first and second mounting means are arranged in such a way that, in the first position, the valve is positioned at a first axial height relative to the container, and that the valve is, in the second position, arranged at a second axial height relative to the container. Thus, simply by moving the valve axially on the container after filling with propellent gas, the valve can move from the first to the second position. For this purpose, the valve body advantageously has a profile which, once the container has been filled with propellent gas, is suitable for facilitating the movement of the valve from the first position into the second position.

Thus, according to an advantageous embodiment, the first and second mounting means are arranged on the valve body at different axial heights, said first mounting means being arranged between the second mounting means and a lower end of the valve body, said valve body having, between the first and second means, a cross section which diminishes in the direction towards the first means.

The second mounting means may, for example, be formed of an annular groove formed on the outer surface of the valve body and capable of collaborating in a sealed manner with a corresponding edge of the container, for example, with the edge of an orifice made at the top of the container.

The containers that can be used for mounting this valve may be selected from the containers customarily used, for example aluminium, tin plate or plastic cans, generally of cylindrical shape. The container may therefore have one open end, a free edge of which delimits an orifice capable of collaborating directly with the valve body mounting means. Alternatively, the container may be equipped with a dished part crimped onto the container provided with the orifice, in which the valve body is engaged.

Any elastomeric material which has a Shore A hardness of from 30 to 70, for example natural or synthetic rubbers, particularly thermoplastic or vulcanizable elastomers, may be used to produce the valve body. Thus, the elasticity of the material of which the valve body is made on the one hand provides the deformation needed for mounting the valve body on the container, in the first position, and allows the valve body to move into the second position. On the other hand, the elasticity of this material also provides sufficient sealing in the second position, so as to resist the internal pressure in the container.

As to the first mounting means, they may also be formed of an annular groove formed on the outer surface of the valve body and capable of collaborating with the corresponding edge of the container, said groove being interrupted by at least one passage formed on the outside of the valve body and opening to the inside of the container, the depth of the passage exceeding the depth of the groove. Advantageously, the passage is directed roughly at right angles to the groove.

In this case, the first and second mounting means are advantageously designed to collaborate with the edge of the container by snap-fastening.

The valve may be a valve which is opened by the sideways tilting of an operating stem through which the outlet passage passes and which constitutes the activation means, this stem being mounted in an outlet duct formed inside the valve body and opening into an internal chamber.

In particular, in this case, the outlet duct may have a longitudinal axis, the valve stem having, inside the outlet duct, a profile capable of collaborating with a complementary profile of the outlet duct, to define an articulation roughly about a predetermined point so that, irrespective of the angular position of the stem relative to the longitudinal axis, the stem is in sealed annular contact with the duct.

According to a preferred embodiment, the stem has, inside the outlet duct, an annular portion which projects relative to the rest of the stem, and a cross section of which is spherical in shape, having a geometric center, the outlet duct having a portion forming a depression of a shape which complements that of the projecting portion and capable of accommodating the projecting portion in a sealed manner, the point of articulation of the stem roughly coinciding with the geometric center.

The activation means for selectively placing the internal valve chamber in communication with the outside of the valve, advantageously comprise a sealing ring, secured to the stem, urged by elastic return means to bear in a sealed fashion on an annular seat formed by the body.

According to one embodiment, the outlet passage of the stem opens into the internal valve chamber via a passage passing radially through the stem and located at the level of the sealing ring.

As to the production of the stem and the sealing ring, they are advantageously made of a rigid thermoplastic, such as polypropylene or polyoxymethylene (POM).

The elastic-return means may consist of at least one elastomeric pad borne by an inner wall of the valve chamber and secured thereto, this one pad bearing elastically against a part of the stem bearing the sealing ring. A valve comprising this kind of return means is described, for example, in the aforementioned European Patent No. 850,851.

Another aspect of the invention consists of a container for dispensing, under pressure, a product which is pressurized by a propellent gas, this container being fitted with a valve as defined earlier.

According to a preferred embodiment of the invention, this valve is mounted on the container via a dished part which has an opening, an interior edge of which is intended to engage with the first or second valve-mounting means. In this case, the dished part is advantageously crimped onto the container.

Yet another aspect of the invention consists of a method for packing a product under pressure in a container which has an opening delimited by an edge, and in which opening the valve defined earlier is mounted, said method consisting in:

a) introducing the product to be dispensed into the container;

b) positioning the valve in a filling position, in which the edge of the container is engaged with a first mounting means of the body of the valve, said first mounting means being capable, in the filling position, of delimiting with the edge of the container at least one passage which is in communication with the container;

c) introducing propellent gas into the container through at least one passage; and d) moving the valve relative to the container so as to position it in a dispensing position in which the edge of the container is engaged with the second mounting means of the valve body, said second mounting means being capable, in the dispensing position, of collaborating with the edge of the container so as to allow the valve body to be mounted in a sealed manner on the container.

In general, the product is introduced through that opening in the container which is used for mounting the valve.

When mounting the valve on the container, the switchover of the valve from the filling position to the dispensing position is advantageously brought about by moving the valve axially relative to the container. This procedure greatly facilitates the automatic filling of the reservoir on a packaging line.

According to a particularly advantageous embodiment, when the valve is in the filling position, multiple passages are arranged uniformly right around the valve body, said container being filled with gas by placing a gas inlet pipe over the valve, said pipe having an edge capable of coming into sealed contact right around the valve with a surface of the container. In general, this surface of the container forms part of valve-holder dished part mounted on the container, this dished part having an opening, the edge of which is capable of collaborating with the first and second valve-mounting means.

The valve which has just been described has other advantages over a conventional valve. Specifically, by making the valve body out of an elastomeric material, the valve body is at the same time made sufficiently elastic that the operating stem can be mounted directly in the valve body without it being necessary to assemble a number of parts.

Furthermore, when the elastic return means are made in the form of pads borne by one of the walls delimiting the internal chamber, these pads can be deformed by crushing, when the valve is actuated. Thus, it is possible to avoid having to use a metal return spring which is likely to come into contact with the product that is to be dispensed, possibly at the risk of degrading the product.

BRIEF DESCRIPTION OF THE DRAWINGS

Other features of the invention will become clear from reading the detailed description of one embodiment of the present invention which will now be described, by way of a purely illustrative and nonlimiting example, and which is depicted in the appended drawings. In these drawings.

DETAILED DESCRIPTION OF THE INVENTION

Figure 1:
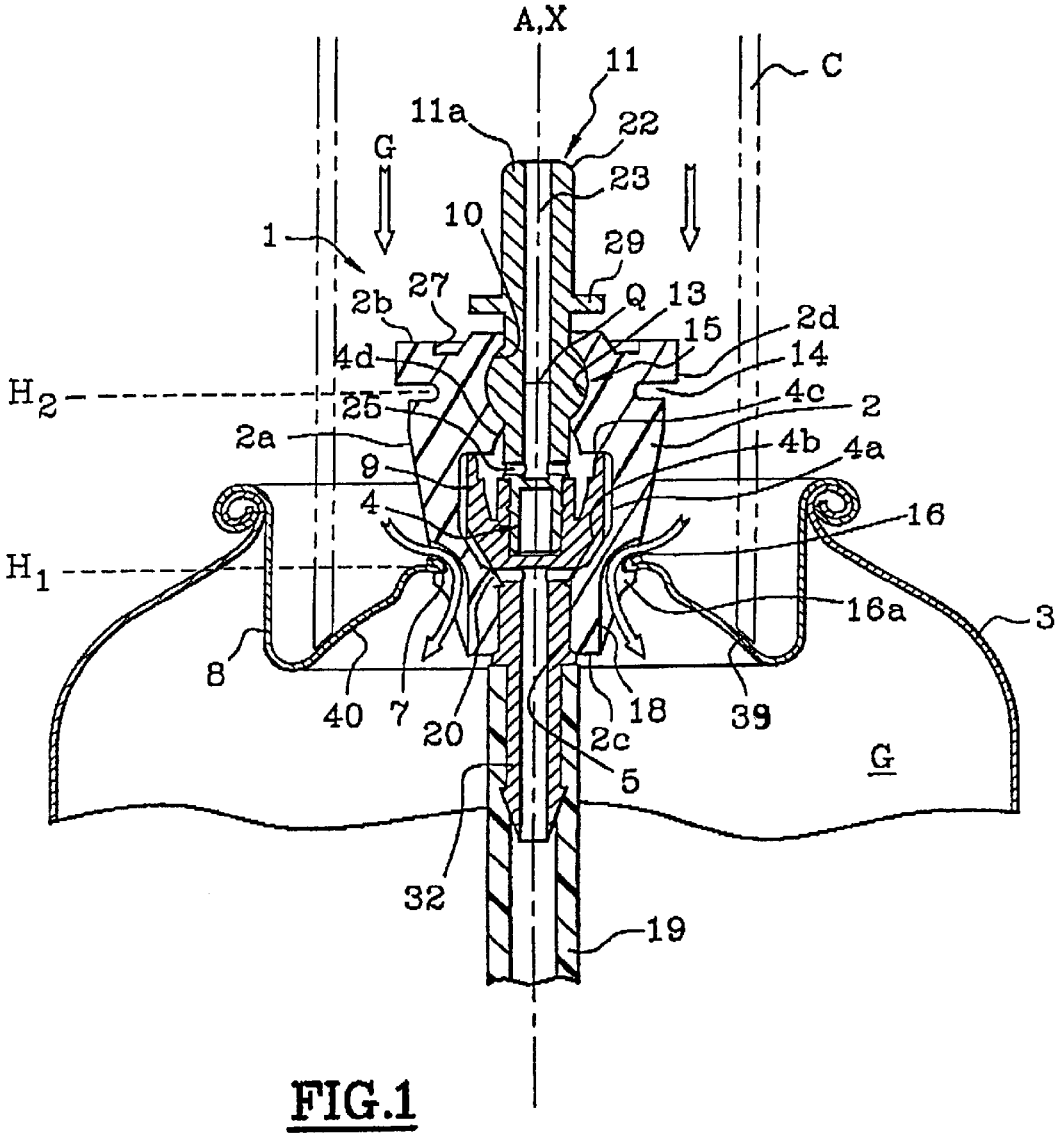
FIG. 1 depicts a view in axial section of a valve according to the invention, mounted on a container in the filling position.
Figure 4:
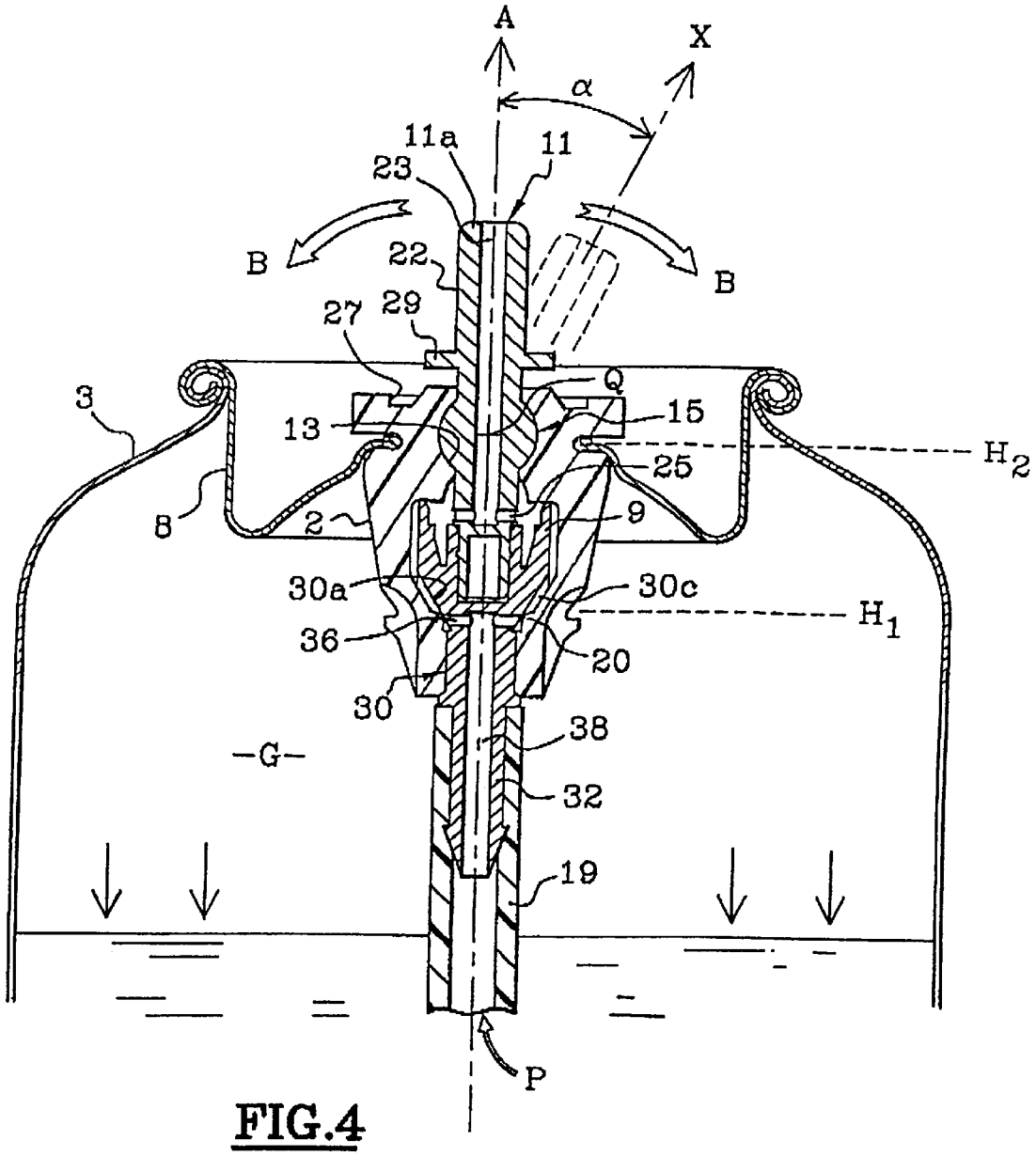
FIG. 4 depicts a view in axial section of the valve of FIG. 1, mounted on a container, in the final mounted position.

The valve 1 according to the invention, depicted in FIGS. 1 and 4 respectively in the filling position and in the sealed mounted position, is intended to be fitted to a dispenser which has a reservoir 3. The reservoir 3 is intended to contain a liquid product, such as a hair lacquer, said reservoir 3 being pressurized by the action of a propellent gas G.

As can be seen particularly in FIG. 1, the valve 1 comprises a body 2 which has a frustoconical central portion 2*a* in the shape of a cone frustum of axis of revolution A, and an operating stem 11, of generally cylindrical shape, which has a longitudinal axis X. When the valve is in the position of rest, the axes A and X are coincident. The stem 11 has an emerging end 1 la and is made in two parts 22 and 30 (see FIG. 3) out of a rigid thermoplastic, such as polyoxymethylene (POM).

The valve body 2 is made of an elastically deformable material, for example an elastomer of a nitrile rubber, the Shore A hardness of which is advantageously in the range from 30 to 70. The body 2 has a large base 2*b* and a small base 2*c* which are connected by the overall frustoconical central portion 2*a* and a cylindrical portion 2*d*.

Formed inside the valve body 2, there is an internal chamber 4 of circular cross section delimited by peripheral walls 4*a*, 4*b*, 4*c*, 4*d*. The wall 4*a* is cylindrical in shape and is connected to the frustoconical wall 4*b*, the bottom of which opens towards the reservoir 3 via an axial duct 5 for letting in product.

The valve body 2, roughly one third up its height (starting from the lower end of the valve body), has an annular groove 16 delimited in part by an annular bulge 16*a*. The position of the groove 16 on the valve body 2 is located at height $H_1$. The annular groove 16 is interrupted by a number of depression regions 18, uniformly spaced and generally numbering from two to four. These regions 18 form open passages when the valve body 2 is mounted in the opening 7 in the dished part 8 at the height $H_1$, at which the edge of the opening 7 collaborates with the annular groove 16. In other words, in this position, the passages through the regions 18 open on each side of the dished part 8. In this position, the reservoir 3 may be filled with propellent gas G from the outside, via the passages through the regions 18. It should be noted that the depth of each passage through the regions 18 is greater than the depth of the groove 16. The annular groove 16 constitutes the first valve mounting means.

The valve 1 comprises, between the cylindrical portion 2*d* and the frustoconical central portion 2*a* of the body 2, at a height $H_2$, second mounting means produced in the form of an annular groove 14. When the valve 1 is mounted in the opening 7 of the dished part 8 engaging with the groove 14, a perfect seal is established between the dished part 8 and the valve body 2.

The axial inlet duct 5, intended to let in the product that is to be dispensed, is made at the center of the small base 2*c* and opens into the internal chamber 4. This inlet duct 5 is connected to a dip tube 19, the free end (not depicted) of which is constantly immersed in the product, via a connecting nozzle 32 borne by the second part of the operating stem 11.

On the opposite side to the inlet duct 5, the cylindrical internal wall 4*a* of the valve body 2 is connected to the annular sealing wall 4*c* located in a plane at right angles to the axis A. The annular wall 4*c* is extended upwards by the second frustoconical wall 4*d*, making it easier for the valve stem 11 to tilt. The top of the frustoconical wall 4*d* opens into a depression 13 of roughly spherical shape. This depression 13 forms part of an outlet duct 10 arranged in the continuation of the inlet duct 5, the duct 10 for its part connecting the internal chamber 4 with the outside. The outlet duct 10 has the first part 22 of the stem 11 passing through it, the outer wall of the valve stem 11 being in perfectly sealed contact against the wall of the valve body 2 delimiting the outlet duct 10. The stem 11 has an annular portion 15 projecting from the rest of the stem 11, and the axial cross section of which is spherical, of a shape which complements the shape of the depression 13 and has a geometric center Q. As will be mentioned later on, when describing the operation of the valve 1, the geometric center Q constitutes a point about which the stem 11 tilts when the valve 1 is actuated.

Figure 2:
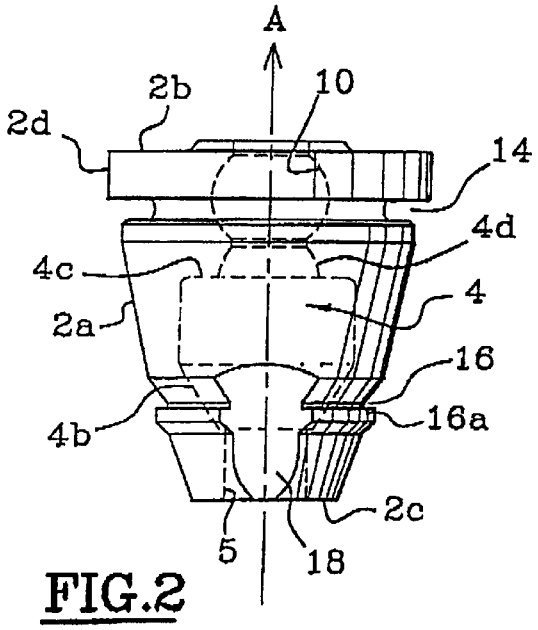
FIG. 2 depicts an enlarged side view of the body of the valve of FIG. 1.
Figure 3:
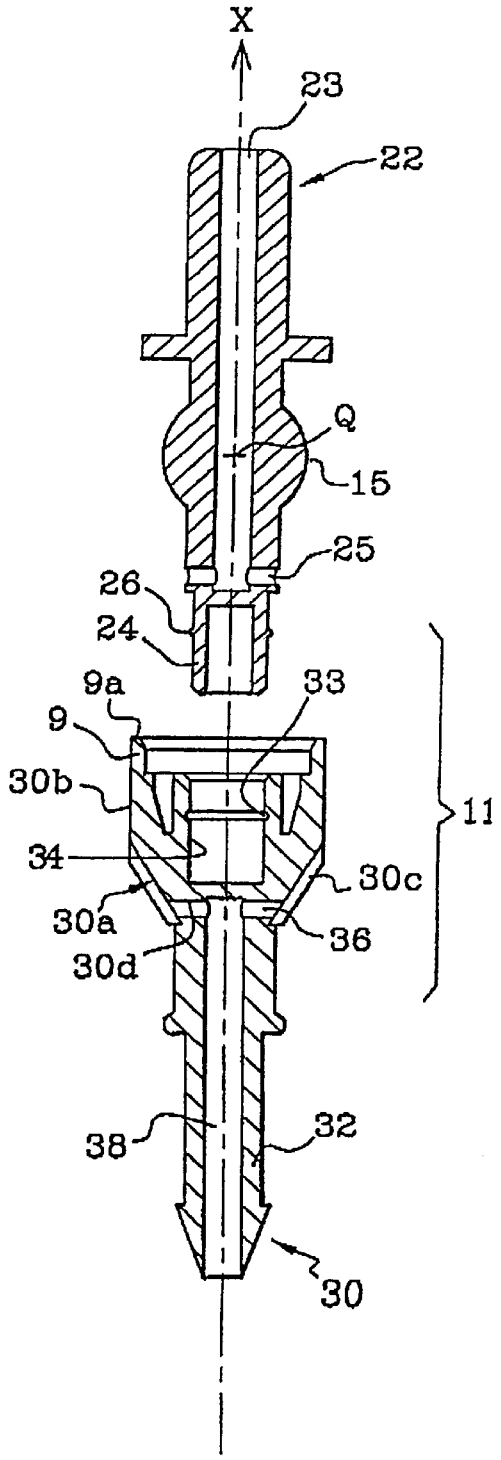
FIG. 3 depicts an enlarged view in axial section of the activating means of the valve of FIG. 1.

As can be seen in FIG. 3, the first part 22 of the valve stem 11 comprises a central dispensing duct 23 passing through the stem 11 from the emerging end as far as a height which lies roughly at the height of the annular wall 4*c* in FIG. 2. At this height, the central duct 23 in FIG. 3 opens into a passage 25 passing radially through the stem 11 and ending in the upper part of the chamber 4 in FIG. 2. The first part 22 of the stem 11 in FIG. 3 further comprises a cylindrical end 24 which has a peripheral bulge 26. This bulge 26 is able to collaborate with a complementary annular groove 33 made on the inside of a blind hollow shaft 34 provided on the upper end of the second part 30 of the valve stem 11. Thus, the two parts 22 and 30 of the valve stem 11 can be assembled by snap-fastening.

The blind hollow shaft 34 is surrounded by a cylindrical ring 9, of larger diameter than the hollow shaft 34 and which is not as tall. A free edge 9*a* of the ring 9 is chamfered, thus forming a somewhat sharp edge, intended to press against the annular wall 4*c* of the chamber 4 in FIG. 2, thus forming a seat. On the opposite side to the ring 9 in FIG. 3, the second part 30 has a cone-frustum-shaped portion 30*a* connected to the ring 9 by a cylindrical portion 30*b* and the cross section of which decreases towards its lower end 30*d*. The frustoconical portion 30*a* of the valve stem 11 has a number of striations 30*c*, oriented in a plane passing through the axis X. The lower end 30*d* of the frustoconical portion 30*a* is extended by the connecting nozzle 32.

In the region where the frustoconical portion 30*a* and the connecting nozzle 32 meet, there is a passage 36 leading radially into the striations 30*c*. The center of the radial passage 36 opens into an intake duct 38 defined inside the nozzle 32, communicating with the dip tube 19 in FIG. 1.

The ring 9 in FIG. 1 is made to bear elastically against the seat-like wall 4*c* by several small tabs or bulges 20 distributed uniformly over the frustoconical internal wall 4*b* of the internal chamber 4 and bearing elastically against the frustoconical portion 30*a* of the valve stem 11 in FIG. 3. Thus, when the valve is in the position of rest, the free edge 9*a* of the ring 9 digs into the seat-like wall 4*c* by a few tenths of a millimeter and creates a perfect seal between the valve chamber 4 and the dispensing duct 23. Furthermore, as seen in FIG. 1, the emerging part 11*a* of the valve stem 11 has a flange 29, against which a tool can rest when the stem 11 is being mounted in the valve body 2.

The valve 1 is simple to mount. Once the two parts 22 and 30 of the stem 11 shown in FIG. 3 have been assembled, the valve stem 11 is introduced, as seen in FIG. 1, axially into the valve body 2 via the outlet duct 10, and this introduction is done in two successive stages as will be seen later. The stem is made easier to introduce into the valve body 2 on the one hand by the frustoconical portion 30*a* of the valve stem 11 seen in FIG. 3 and, on the other hand, by the elasticity of the elastomeric material of which the valve body 2 of FIG. 2 is made. During mounting as shown in FIG. 1, the axial travel of the valve stem 11 is limited by the flange 29, and the stem 11 correctly positions itself in the valve chamber 4. It will be noted that, unlike certain conventional valves, no ball or spring is needed to make this valve 1 work.

To package an aerosol product according to the invention, an appropriate amount of product is introduced into the reservoir 3 on which the dished part 8 has already been fixed, for example by crimping. The valve 1 is positioned in the opening 7 of the dished part 8 at the filling height $H_1$. In this position, the edge of the opening 7 of the dished part 8 engages with the groove 16. A propellent gas inlet pipe C, designed to convey the propellent gas G into the reservoir 3 is then placed over the dished part 8, in a region 40 surrounding the valve 1. A free end 39 of the filling pipe C can be fitted, in a sealed manner, over the dished part 8. Advantageously, in order to minimize losses of the propellent gas G, the inside diameter of the filling pipe C is chosen to be slightly greater than the largest diameter of the valve body 2. An appropriate amount of propellent gas G is then introduced into the reservoir 3, via the passages formed by the depression regions 18.

Still in the presence of the propellent gas G in the filling pipe C, the valve body 2 is made to move axially towards the reservoir 3. To achieve this movement, it is possible to envision a mounting element (not depicted) which can move axially inside the filling pipe C and be placed over the upper face of the large base 2*b* of the valve body 2 and push the body towards the reservoir 3. Advantageously, this mounting element is tubular, so that it can accommodate the emerging part 11*a* of the valve stem 11 in its hollow center. After the edge of the opening 7 of the dished part 8 has been disengaged from the groove 16, it is possible to make this edge slide along the frustoconical portion 2*a* of the valve body 2, by virtue of the elastomeric material of which the valve body 2 is made. At the end of the translational movement thus performed, the edge of the opening 7 of the dished part 8 becomes housed in the groove 14. At this instant, the valve 1 is fixed to the reservoir 3 in a stable and sealed manner, and the stream of propellent gas G can be disconnected.

The advantages of the method of assembling and of packing a pressurized container according to the invention, are as follows:

- a high pressurization rate is achieved on a packaging line, which cannot be achieved with a conventional valve;
- the cost of mounting the valve on the reservoir is reduced, because it is possible to dispense with the crimping of the valve onto the dished part;
- the cost of mounting the valve in itself is less by comparison with a conventional valve which comprises a ball and a metal return spring and requires an additional mounting seal; and
- the valve has fewer constituent parts than a conventional valve.

The way in which the valve works is explained hereinbelow with reference to FIG. 4. To actuate the valve, the stem 11 is inclined relative to the axis A. This inclining may be performed in any radial direction relative to the axis A, as symbolized by the arrows B. During this pivoting, the axis X of the stem is inclined relative to the axis A of the valve body 2, an angle $\alpha$ being formed between the two axes A and X typically being of the order of 2° to 15°. During this pivoting, part of the ring 9 moves away from the seat-like wall. At the same time, the bulges 20 lying on the frustoconical wall on the opposite side to the region moving away from the ring 9, will be crushed by the frustoconical portion 30*a* of the stem 11. In the embodiment, four tabs or bulges 20 of elongate shape, about 1 mm high, about 1.5 mm wide and about 1.5 mm long, have been produced. Under the thrust of the propellent gas G, a product P is therefore conveyed into the internal chamber via the dip tube 19, the intake duct 38, the radial passage 36 and the striations 30*c*. Thereafter, the product P is conveyed through the parted region of the ring 9 into the passage 25 to reach the dispensing duct 23. When the pivoting of the stem 11 ceases, the dispensing of the product P stops, because the ring 9 comes back into sealed contact against the seat-like wall. As the valve stem 11 pivots in the outlet duct, the annular portion 15 of the stem 11 provides perfectly sealed annular contact with the valve body 2, in the region of all or some of the spherical portion of the depression 13.

In the conventional way, the emerging end 11*a* of the valve stem 11 is engaged in an actuating member which also allows the product P to be dispensed. Thus, a push button fitted with a dispensing orifice or a dispensing head (not depicted), conventionally used with this type of dispenser, may be mounted on the valve stem 11.

Numerous modifications and variations of the present invention are possible in light of the above teachings. Therefore, it is to be understood that, within the scope of the appended claims, the invention may be practiced otherwise than as specifically described herein.

What is claimed is:

1. Valve, intended to be fitted to a reservoir containing a product which is pressurized by a propellent gas, having a valve body and an activation device for, in response to an actuation command, causing the valve to move from a closed position into a position which allows the product to be dispensed via an outlet passage of the valve body; said valve being, in the absence of any actuation command, forced into the closed position; said valve body comprising:

a first mounting element to allow the valve to be mounted in a first position in which the valve body defines, with an edge of an opening in the reservoir, at least one passage communicating with the reservoir, so as to allow the reservoir to be filled with a propellent gas; and a second mounting element to allow the valve to be mounted in a second position in which the valve body is mounted in a sealed fashion on the edge of an opening in the reservoir.

2. Valve according to claim 1, characterized in that the first and second mounting elements are arranged in such a way that, in the first position, the valve is positioned at a first axial height relative to the reservoir, said valve in the second position being arranged at a second axial height relative to the reservoir.

3. Valve according to claim 1, characterized in that the valve body has a profile which, after the reservoir has been filled with the propellent gas, is suitable for facilitating movement of the valve from the first position into the second position.

4. Valve according to claim 1, characterized in that the first and second mounting elements are arranged on the valve body at different axial heights, said first mounting element being arranged between the second mounting element and a lower end of a small base of the valve body, said valve body having, between the first and second mounting elements, a cross section which diminishes in a direction towards the first mounting element.

5. Valve according to claim 1, characterized in that the second mounting element is an annular groove formed on an outer surface of a central portion of the valve body and is capable of collaborating in a sealed manner with the edge of the opening in the reservoir.

6. Valve according to claim 1, characterized in that the first mounting element is an annular groove formed on an outer surface of a central portion of the valve body and is capable of collaborating with the edge of the opening in the reservoir, said groove being interrupted by at least one passage formed on the outer surface of the central portion of the valve body and opening to an inside of the reservoir, a depth of the one passage exceeding a depth of the annular groove.

7. Valve according to claim 1, characterized in that the first and second mounting elements are capable of collaborating with the edge of the opening in the reservoir by snap-fastening.

8. Valve according to claim 1, characterized in that the valve body is made of elastomeric material which consists, in particular, of a thermoplastic elastomer.

9. Valve according to claim 8, characterized in the said elastomeric material has a Shore A hardness lying in the range from 30 to 70.

10. Valve according to claim 1, characterized in that the valve operates by sideways tilting of a stem through which the outlet passage passes, said stem forming the activation device and being mounted in an outlet duct formed in the valve body.

11. Valve according to claim 10, characterized in that the outlet duct has an axis and the valve stem has, inside the outlet duct, a profile capable of collaborating with a complementary profile of an annular portion of the outlet duct to define an articulation roughly about a geometric center so that, irrespective of an angular position of the stem relative to the axis, the stem is in sealed annular contact with the outlet duct.

12. Valve according to claim 10, characterized in that the stem has, inside the outlet duct, an annular portion which projects relative to the rest of the stem, and a cross section which is spherical in shape, having a geometric center, said outlet duct having a portion forming a depression which has a shape complementing that of the annular portion and which is capable of accommodating the annular portion in a sealed manner, wherein a point of articulation of the stem roughly coincides with the geometric center.

13. Valve according to claim 1, characterized in that the activation device selectively places an internal chamber in communication with an outside of the valve and includes a sealing ring urged by an elastic return bulge to bear in a sealed fashion on an annular seat wall formed by the valve body.

14. Valve according to claim 13, characterized in that the outlet passage opens into the internal chamber via another passage passing radially through the activation device.

15. Valve according to claim 13, characterized in that the activation device and the ring are made of a rigid thermoplastic.

16. Valve according to claim 13, characterized in that the elastic return bulge consists of at least one elastomeric pad borne by a peripheral wall of the internal chamber and secured thereto, said at least one elastomeric pad pressing elastically against a connecting nozzle bearing the sealing ring.

17. Container for dispensing, under pressure, the product which is pressurized by the propellent gas, characterized in that the container is fitted with the valve according claim 1.

18. Container according to claim 17, characterized in that the valve is mounted on the reservoir via a dished part having the edge of the opening which is intended to engage with one of the first or second mounting elements.

19. Container according to claim 18, characterized in that the dished part is crimped onto the reservoir.

20. Method for packing a product under pressure in a reservoir which has an opening delimited by an edge, and in which opening a valve is mounted, said method comprising the steps of:

a) introducing the product into the reservoir;

b) positioning the valve in a filling position in which the edge of the reservoir is engaged with a first mounting element of a body of the valve, said first mounting element being capable, in the filling position, of delimiting with the edge of the reservoir at least one depression region which is in communication with the reservoir;

c) introducing propellent gas in to the reservoir through said at least one depression region; and d) moving the valve relative to the reservoir so as to position the valve in a dispensing position in which the edge of the reservoir is engaged with a second mounting element of the body of the valve, said second mounting element being capable, in the dispensing position, of collaborating with the edge of the reservoir so as to allow the body of the valve to be mounted in a sealed manner on the reservoir.

21. Method according to claim 20, characterized in that the product is introduced through the opening.

22. Method according to claim 20, characterized in that a switchover from the filling position to the dispensing position is brought about by moving the valve axially relative to the reservoir.

23. Method according to claim 20, characterized in that the edge of the reservoir is an inside edge of a dished part mounted on the reservoir.

24. Method according to claim 20, characterized in that, when the valve is in the filling position, multiple depression regions are arranged uniformly right around the body of the valve, said reservoir being filled with gas by placing a gas inlet pipe over the valve, said gas inlet pipe having a free edge capable of coming into sealed contact, right around the valve, with a surface region of a dished part of the reservoir.

* * * * *